United States Patent [19]

Shriver

[11] Patent Number: 4,683,009

[45] Date of Patent: Jul. 28, 1987

[54] BOTTLE DRYING APPARATUS

[75] Inventor: Frank L. Shriver, Lakewood, Colo.

[73] Assignee: Adolph Coors Company, Golden, Colo.

[21] Appl. No.: 718,213

[22] Filed: Apr. 1, 1985

[51] Int. Cl.[4] ..... B08B 3/04

[52] U.S. Cl. ..... 134/30; 134/66; 134/95; 134/99; 134/105; 134/166 R; 134/170

[58] Field of Search ..... 134/66, 73, 95, 99, 134/105, 166 R, 170, 19, 22.1, 22.11, 22.12, 22.15, 30; 15/304; 198/599, 624, 633; 34/105; 118/66, 64

[56] References Cited

U.S. PATENT DOCUMENTS

| | | | |
|---|---|---|---|
| 1,625,493 | 4/1927 | O'Connell et al. | 34/105 X |
| 1,775,003 | 9/1930 | Soelch | 134/73 X |
| 1,972,711 | 9/1934 | Kendall | 34/105 X |
| 2,140,589 | 12/1938 | Lannmark | 134/170 X |
| 2,184,100 | 12/1939 | Mondloch | 134/66 X |
| 2,730,068 | 1/1956 | Reynolds et al. | 134/66 X |
| 3,421,840 | 1/1969 | Pechman | 34/105 X |
| 4,051,805 | 10/1977 | Waldrum | 134/170 X |
| 4,053,993 | 10/1977 | Schregenberger | 34/105 |
| 4,080,974 | 3/1978 | Oag | 134/68 |
| 4,154,624 | 5/1979 | Wahl et al. | 134/105 |

*Primary Examiner*—Harvey C. Hornsby
*Assistant Examiner*—Frankie D. Stinson
*Attorney, Agent, or Firm*—Klaas & Law

[57] ABSTRACT

A method and apparatus for high speed drying of the interior surfaces of a plurality of plastic bottles without causing heat deterioration of the bottles. Bottles to be dried are heated through application of a heated liquid to the exterior surface thereof while a gas jet is simultaneously directed into the bottle interior. Method and apparatus for continuously moving and rotating the bottles during the drying process is also described.

23 Claims, 3 Drawing Figures

BOTTLE DRYING APPARATUS

BACKGROUND OF THE INVENTION

The present invention relates generally to plastic bottle formation and, more particularly, to a bottle drying apparatus for high speed production line drying of a liquid coating material applied to the interior surfaces of a plurality of plastic bottles.

Containers constructed from thermoplastic material have become widely used in the beverage industry, competing with traditional metal and glass containers. Attractive features of plastic containers include high resistance to rupture, transparency and light weight. A drawback of thermoplastic beverage bottles has been the relatively high cost of the plastic materials which are presently used to produce such bottles. Polystyrene, which costs significantly less than most plastics presently used to form bottles, is readily available as a by-product from the formation of more expensive plastic materials. However, there are presently no polystyrene containers in commercial use as containers for pressurized beverages because of a number of production related problems. Polystyrene bottles to be economically feasible must be capable of being produced rapidly and, as a finished product must be able to contain carbonated beverages under pressure without significant loss of carbonation from the beverage or without diffusion of oxygen from the atmosphere into the beverage.

The molecular structure of polystyrene is such that for wall thicknesses that are sufficiently thin to be economically feasible, a coating layer of another material must be applied over the inner surface of the bottle to limit gas diffusion to acceptable levels. Additionally, it has been found that a coating layer of chemically inert material may be necessary to isolate the bottle contents from physical contact with the polystyrene to prevent chemical reaction therewith and deterioration of the taste of the bottled beverage. The most efficient manner presently known by applicant to provide a barrier between the bottled contents and the polystyrene material forming the bottle is to apply first a coating layer of latex primer material and, after the primer layer has dried, to apply a top coat layer of polyvinylidene chloride latex (PVDC latex). A high speed spray coating apparatus for applying such coating layers is disclosed in U.S. patent application, Ser. No. 685,022 of Frank Leroy Shriver and Roger Alan Hahn, filed Dec. 21, 1984, which is hereby incorporated by reference for all that it discloses.

After a spray coating is applied to the interior surface of a plastic bottle, the coating layer must be dried before further production processes, including filling of the bottle with a beverage, may commence. The coating layer must be dried quickly for economic production of the bottles. However, if the bottles are exposed to extreme heat such as applied by a radiant heater or conventional convection driers, the plastic material from which the bottle is constructed may be adversely effected. Beverage cans are conventionally dried using convection heating methods during which high temperature air, e.g. 400 to 500 degrees Fahrenheit, is blown onto the inside and outside surfaces of the can. The extreme heat of this process and the difficulty of blowing air into the small opening of a bottle make this process impractical for plastic bottles. Additionally, even in can drying, this process is quite slow, taking on the order of two minutes to complete. If a plastic bottle is exposed to extreme temperatures for even a short period of time, the strength of the bottle may be reduced. When exposed to extreme temperatures for a longer period of time, a bottle may physically deform. Thus, in order to provide an economically feasible production process for plastic bottles used in the beverage industry, it is necessary to dry a spray coating layer applied to the interior of a bottle in a rapid manner without subjecting the bottle to extreme temperatures.

Applicant has discovered that the PVDC coating layer applied to the interior of the plastic bottles has a tendency to form a surface film which inhibits further drying of the coating layer. In order to provide proper drying of this type coating material it is desirable to cause the portion of the coating layer adjacent the bottle wall surface to dry before the exposed surface of the coating layer begins to form a film. Thus, the bottle drying method should facilitate drying of the coating laye from the bottle surface outwardly toward the exposed surface.

SUMMARY OF THE INVENTION

The present invention comprises a method and apparatus for rapidly drying the interior surfaces of a plurality of plastic bottles without subjecting the bottles to physical deterioration.

The invention may include an apparatus for high speed production drying of the interior surfaces of polystyrene bottles or the like having a generally cylindrical configuration with a tapering upper shoulder portion, and a neck portion defining a central bottle opening, the apparatus comprising: a plurality of cylindrical sleeves having a diameter slightly greater than the maximum diameter of the bottles to be dried and having a height approximately equal to the shoulder height of the bottles, said cylindrical sleeves each having a base surface for supporting a bottom surface of a bottle thereon, an inner centering and shock absorption means to provide proper placement of the bottle within the sleeve and to absorb shocks, an open upper end enabling insertion of a bottle into said sleeve in approximately coaxial relationship therewith, and an opening in a lower portion thereof to facilitate removal of heating water therefrom; generally horizontally disposed sleeve infeed means for feeding said plurality of sleeve means and a plurality of bottles mounted in upright relationship therein into a drying path conveyor, said sleeve infeed means including a horizontal feed track and a horizontally disposed screw positioned parallel to said feed track, said screw having a spiral groove with a surface adapted to engage exterior surfaces of said sleeve means for producing spaced apart horizontal displacement of said sleeve means along said horizontal feed track; horizontally disposed drying table means rotatable about a central vertical axis for receiving said sleeve means in spaced apart relationship from said infeed means and for conveying said sleeve means and associated bottles through a drying path; horizontally disposed takeoff means for sequentially removing said sleeve means and associated bottles from said drying table means, said takeoff means comprising a horizontally disposed rotatable takeoff table positioned adjacent said drying table means and rotatable at a speed whereby the tangential peripheral speed of said drying table means is approximately equal to the tangential peripheral speed of said takeoff table; a plurality of circumferentially, equally spaced apart bracket means fixedly mounted on an outer peripheral portion of said rotatable drying table means and adapted to receive said sleeve means from said sleeve infeed means, said bracket means having at least two arm portions defining a radially outwardly opening enclosure and having rollers disposed thereon for allowing relative rotational movement of said sleeve means within said bracket means resilient band means positioned proximate the periphery of said drying table means in generally tangential relationship therewith in frictionally contacting relationship with said sleeve means, said drying table means being rotatable relative said band means whereby said sleeve means are rotatable within said bracket means by said frictional contact with said band means; weir means for dispensing a uniform flow of heated water from an arcuate lip portion thereof positioned above said drying wheel, said lip portion being disposed such that said heated water flow is directed onto the shoulder portion of bottles positioned in said sleeve means at a position thereon outwardly of the bottle openings whereby said heated water heats the bottle without entering the bottle openings; drain channel means disposed below said table means beneath said bracket means for draining water flowing from said weir means; a plurality of air jet directing means fixedly mounted on said drying table means and operatively associated with said bracket means for directing a drying airflow into a bottle positioned in a sleeve engaged by said bracket means; manifold means fixedly mounted at a central position on said drying table means and connected in fluid communication with said air jet directing means for providing uniform pressure airflow to said air jet means; said manifold means being operatively attached to a heated, pressurized air source by an air duct and rotating seal; drive means for driving said infeed screw, said drying table means and said takeoff table in synchronized relationship.

The invention may also include a method of drying the internal surface of a plurality of bottles comprising the steps of mounting each bottle in a sleeve; moving the sleeves and bottles along a predetermined drying path; rotating each bottle about its central longitudinal axis as it is moved along the drying path; directing a stream of heated water onto an upper shoulder surface of each bottle as it is moved along the drying path; directing a stream of pressurized air into each bottle as it is moved along the drying path.

DETAILED DESCRIPTION OF THE INVENTION

Figure 1:
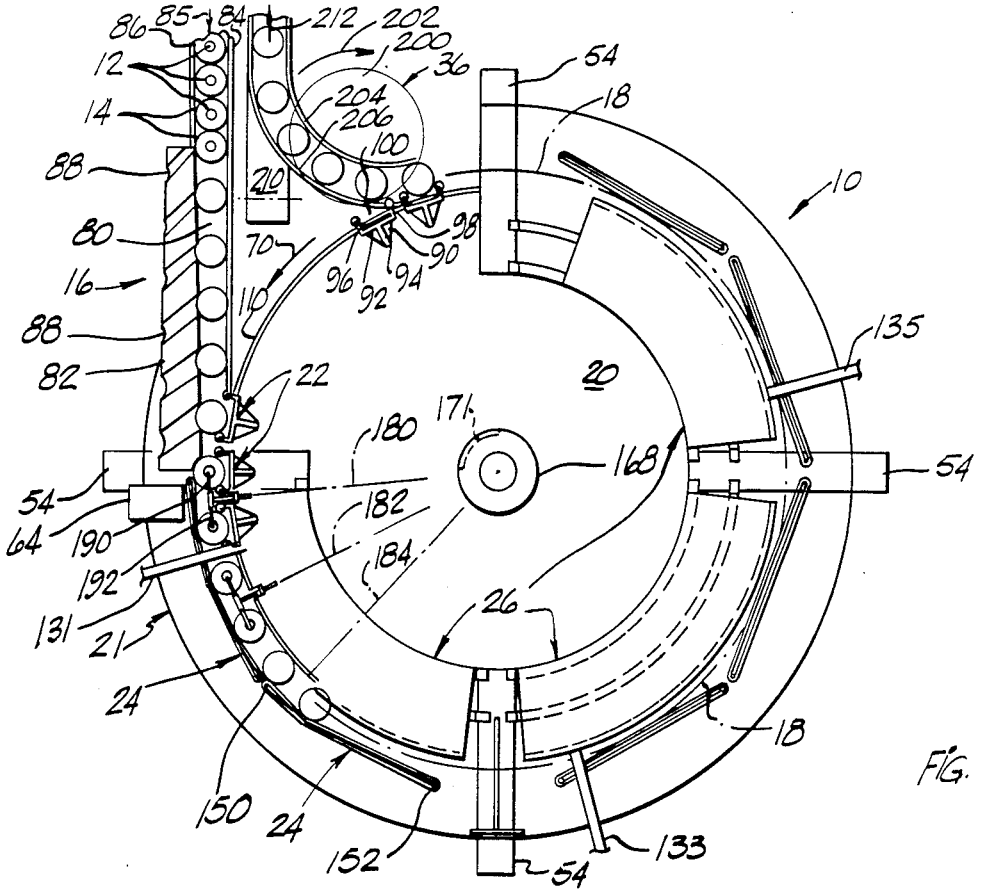
FIG. 1 is a plan view of a bottle drying apparatus.

As best illustrated in FIG. 1, the bottle drying apparatus 10 of the present invention is adapted to dry a plurality of plastic bottles 12 or the like in a relatively high speed operation without exposing the bottles to extreme temperatures which might tend to cause deterioration of the bottles and/or cracking of the interior coating provided thereon in an earlier spray coating operation. In general, the apparatus comprises a plurality of sleeves 14 in which the bottles are mounted prior to entering a drying path 18; an infeed device 16 which feeds the sleeves and associated bottles into a generally circular drying path in sequential, equally spaced apart relationship; a horizontally disposed drying table 20 having a plurality of radially outwardly opening bracket means 22 mounted in circumferentially spaced relationship at the outer periphery of the table; a plurality of sleeve rotating means such as resilient bands 24 positioned on fixed support structure around the periphery of the drying table 20 and in frictional contact with sleeves 14 received within brackets 22; a plurality of weirs 26 positioned above the drying table 20 and having a lip portion 28 for directing a continuous flow of heating water 30 onto an upper portion of the bottles 12; air directing means such as air jet conduits 32 fixedly mounted on the drying table 20 for rotation therewith and terminating opposite the opening in each bottle received within a sleeve and positioned within a bracket 22; and a takeoff device 36 mounted adjacent the drying table 20 for removing sleeves 14 and associated dried bottles 12 from the drying table 20. In operation, bottles 12 mounted within sleeves 14 are fed onto drying table 20 in spaced apart relationship such that each sleeve is received within a bracket 22. As drying table 20 rotates, each sleeve 14 is moved by an associated bracket 22 in a circular drying path. The sleeve 14 and associated bottle 12 are supported vertically by a circular support ring 21 positioned in adjacent concentric relationship with the drying table 20 in substantially coplanar relationship therewith. Resilient bands 24 mounted on the support ring 21 frictionally contact the sleeves 14 causing rotation thereof within the associated brackets 22 as the sleeves revolve about the central rotation axis CC of the drying table. At approximately the point whereat a sleeve 14 is fed onto the drying table 20, it enters a continuous cascade of heated water 30 from weirs 26. The bottle 12 within each sleeve is subjected to this continual cascade of water throughout an arcuate path which, in the preferred embodiment, is about 270 degrees of arc. The construction and arrangement of the sleeves 14 are such that heating water flowing downwardly from the shoulder of the bottle, is caused to flow through a narrow channel defined by the cylindrical walls of the bottle and sleeve and is thus relatively uniformly distributed over the surface of the bottle 12. Water flowing from the lower opening of the sleeve and also off the surface of support ring 21 is directed into an arcuate drain channel 31 positioned immediately below suppor ring 21 and the outer periphery of drying table 20. The heating water 30 raises the temperature of the bottle and facilitates drying of the interior surface thereof. At approximately the same point where the bottle is first subjected to the cascade of heating water, air from an associated air jet conduit 32, FIG. 3., is directed into the interior of the bottle causing evaporation of liquid from the coating mixture previously applied to the interior of the bottle. The bottle interior is continuously subjected to the air flow from air jet 32 throughout the drying path defined by the water cascade. The heat of the water and air stream and the flow rates thereof, are sufficient to cause the bottle interiors to be completely dried after a single pass through the drying path. The bottles are thereafter removed from the drying table at the takeoff device 36 and may subsequently be removed from the sleeves 14 and undergo additional processing and filling operations.

Having thus described the structure and operation of the drying apparatus in general, the apparatus will now be described in further detail.

Figure 3:
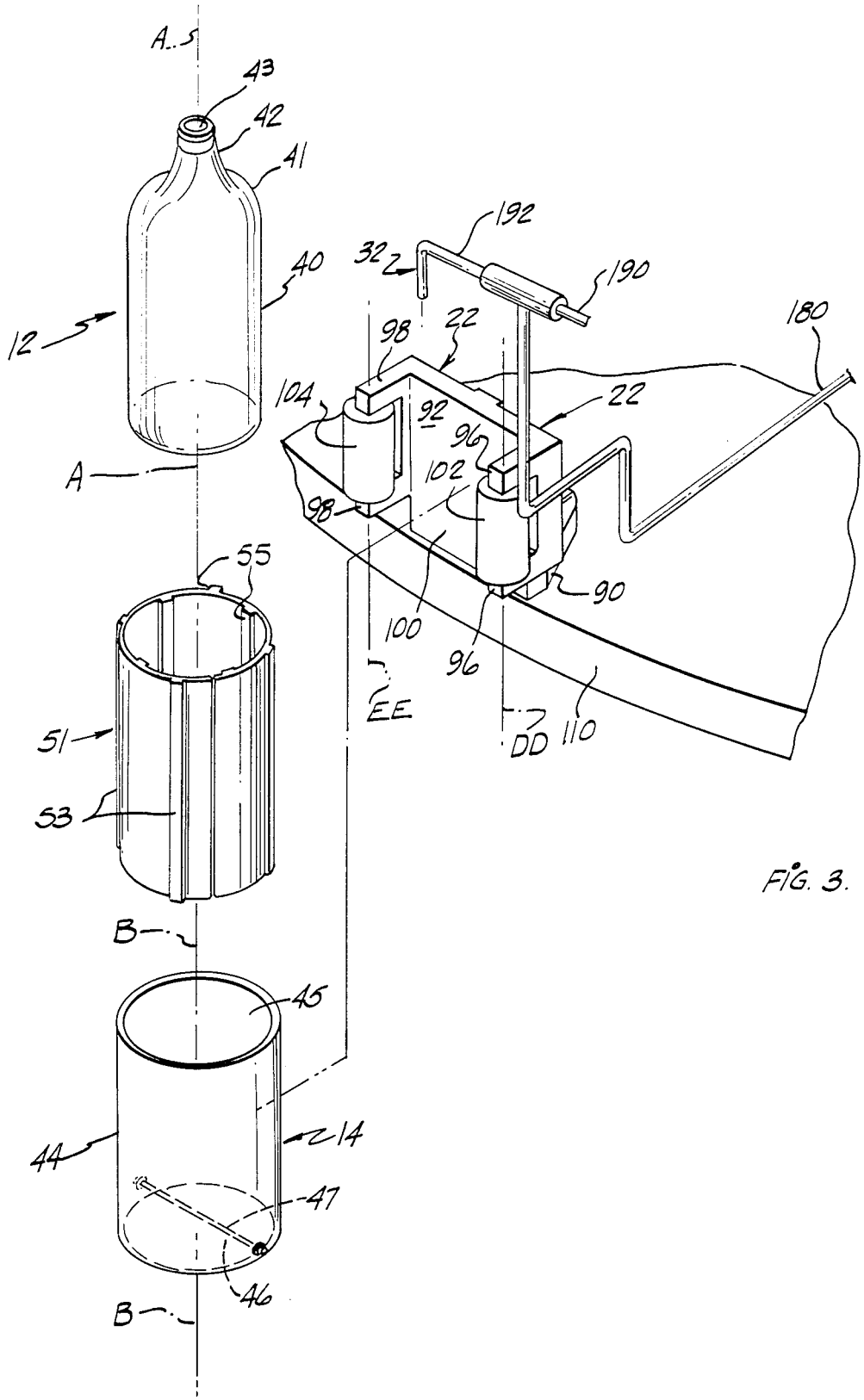
FIG. 3 is an exploded, detailed, perspective view of a portion of a bottle drying apparatus.

As indicated by FIG. 3, in the preferred embodiment, each bottle 14 comprises a cylindrical body portion 40 which tapers inwardly at the upper portion thereof in a shoulder 41 which is, in turn, integrally attached to a relatively narrow cylindrical neck 42 which defines a circular bottle opening 43. The bottle has a central longitudinal axis AA which is positioned in parallel, substantially coaxial relationship with the central longitudinal axis BB of an associated sleeve 14. As further illustrated by FIG. 3, each sleeve 14 comprises a cylindrically shaped tubular body portion 44 having an internal diameter slightly larger than the external diameter of the cylindrical body portion 40 of an associated bottle 12. In a preferred embodiment, the internal diameter of the sleeve 14 may be between $\frac{1}{8}$ inch and $\frac{1}{2}$ inch larger than the diameter of the bottle cylindrical body portion 40 and is preferably about $\frac{1}{4}$ inch larger. The sleeve has an upper unrestricted circular opening 45 enabling the bottle to be inserted and removed therefrom and comprises a lower opening 46 which is partially restricted by a bottle lower support means such as a single shaft 47 which may be connected to the sleeve body portion 44 as by a pair of diametrically opposed holes therein and snap rings 49 or other conventional attachment means well known in the art. The shaft 47 is positioned above the lower surface of the body portion 44 such that a planar surface is provided at the lower end of the sleeve body portion 44 enabling the sleeve to be free standing. The length of the sleeve cylindrical body portion 44 is preferably approximately equal to the shoulder height of the bottle 12. It may be seen that such a sleeve configuration enables water flowing onto a shoulder surface of the bottle to be channelled between the bottle cylindrical wall portion 40 and the sleeve body portion 44. In one preferred embodiment of the invention, each sleeve 14 also comprises a resilient inner sleeve 51 formed from a resilient material such as rubber, plastic, or the like. The inner sleeve may be constructed from a rectangular shaped plate which is folded into a tubular configuration and inserted into the sleeve body portion 44. The inner sleeve preferably comprises a plurality of axially extending outer ribs 53 and inner ribs 55 which provide a first annular gap between the inner sleeve 51 and sleeve body portion 44 and a second annular gap between inner sleeve 51 and bottle body portion 40. The dimensions of the sleeve body portion 44, inner sleeve 51 and bottle body portion 40 are such that the bottle is tightly frictionally engaged by ribs 5 whereby it is centered within the sleeve 14. The resilience of the inner sleeve 51 and the gapped configuration also provides a non-abrasive shock absorber means for absorbing shocks to the sleeve 14 and bottle 12. The inner sleeve 51 is preferably the same height as sleeve body 44. Also, due to the relatively small dimension of the gap formed between the bottle and sleeve 51, the water tends to distribute itself uniformly over the surface of the bottle. This uniform flow distribution is further enhanced by rotation of the bottle within an associated bracket 22, as discussed in further detail hereinafter.

Figure 2:
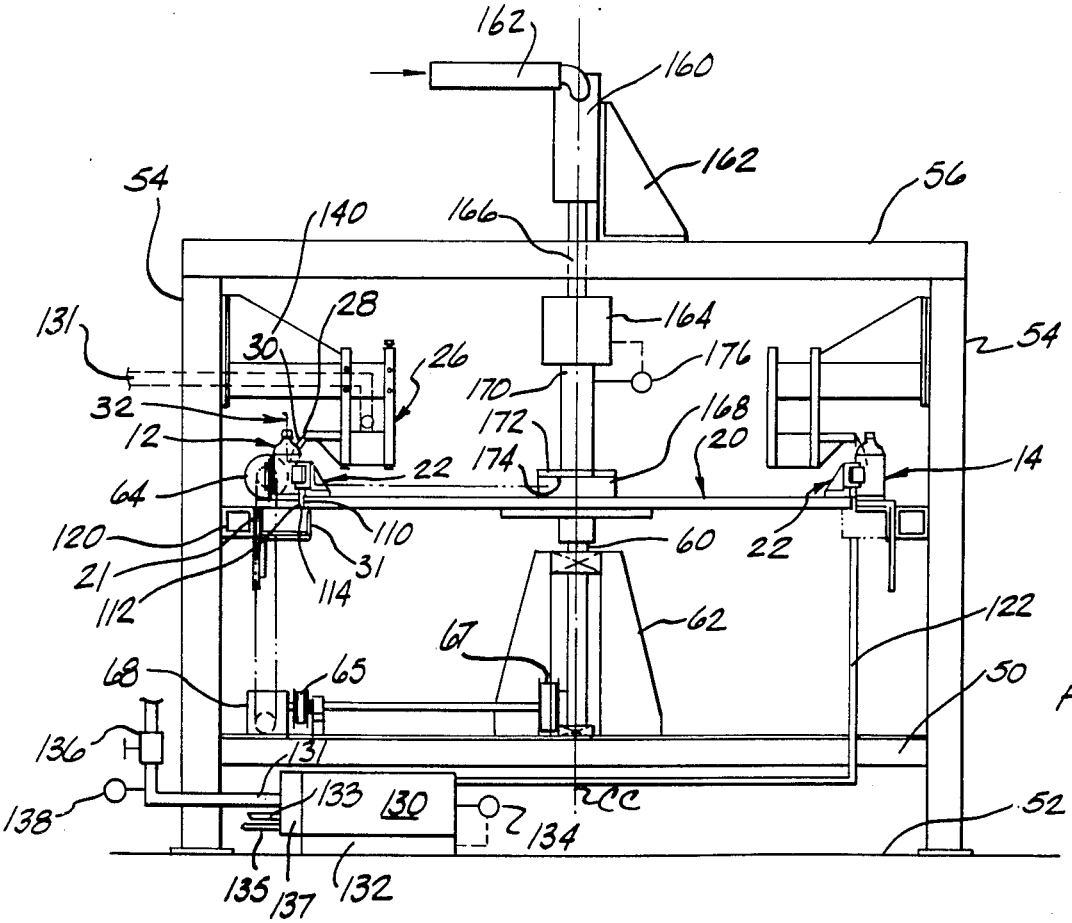
FIG. 2 is an elevation view of a bottle drying apparatus.

As best illustrated by FIG. 2, the apparatus may be supported on a horizontally disposed circular platform 50 mounted above a base surface 52 by a plurality of vertical support members 54. An upper horizontally extending support structure 56 may also be supported by vertical support members 54. Drying table 20 may be fixedly attached to a rotation shaft 60 extending coaxially with the central longitudinal axis CC of the drying table 20. The shaft 60 may, in turn, be supported in a vertically upright position by bearing assembly 62 fixedly mounted on circular platform 50. The drying table 20 may be rotated by a suitable drive means such as electrical drive motor 64 and conventional drive linkage 68 operably linking the drive motor 64 with shaft 60. The drive motor 64 may also be drivingly linked by suitable conventional apparatus (including pulley and belt assemblies 65, 67) to the infeed device 16 and the takeoff device 36, such that the infeed device, drying table and takeoff device are properly speed matched and driven by a single power source. Alternately, separate drive apparatus and suitable synchronization and control devices may be provided to drive the infeed device 16 and takeoff device 36. In the embodiment illustrated in FIG. 1, the drive motor 64 drives the drying table 20 in a counterclockwise direction, as viewed from above, as indicated at 70.

The infeed device 16 in the presently preferred embodiment, includes a horizontally disposed guide track 80 and a horizontally disposed screw 82 positioned in adjacent parallel alignment with the guide track. The guide track includes a pair of vertically upright rail members 84, 86 attached at the lateral edges thereof which maintain sleeves 14 and bottles 12 mounted therein in aligned relationship. The sleeves are initially moved along the guide track 80 in a direction indicated at 85 as by a gravity feed means, conveyor means or other conventional conveying devices positioned upstream of the guide track 80. At the position on the guide track where it initially comes into adjacent relationship with the screw 82, guide rail 86 terminates. One side of the sleeves 14 passing along the guide track 80, thus come into contact with the surface of screw 82. The screw 82 comprises a spiral groove 88 therein having a longitudinal dimension sufficiently large to engage the lateral side surface of a sleeve 14. The distance between the screw 82 and guide rail 84 is sufficiently close so as to form a retaining relationship between the screw groove and a sleeve 14 from the point where the sleeve first comes into contact with the screw groove, to a point near the terminal end of the screw, where guide rail 84 terminates and the associated sleeve 14 is accepted by a bracket 22 on the drying table 20.

As illustrated in FIGS. 1–3, brackets 22 are mounted on a peripheral portion of the drying table 20 as by a base portion 90 and associated screws or other conventional attachment means. The brackets are spaced circumferentially the same distance as the distance between sleeve centers at the position where the sleeves 14 leave the infeed rack 80. This distance may be, e.g. 8 inches. Each bracket 22 comprises a generally tangentially extending member 92 which is fixedly attached to the base 90. Each tangential member has fixedly mounted at opposite end portions thereof, a pair of radially extending arm members 96, 98 which, with the tangential member 92, form a generally C-shaped radially outwardly opening enclosure 100. A pair of rollers 102, 104 are mounted on associated arm members 96, 98 and are rotatable about vertically extending axes DD, EE. Each bracket member 22 thus forms an outwardly opening C-shaped enclosure 100 which accepts a sleeve member 14 in rotatable relationship therewithin about a vertical axis defined by the sleeve axis BB at its position within the bracket. As shown by FIG. 2, the construction and arrangement of each bracket 22 on the drying table 20 is such that a sleeve 14, engaged by the bracket 22, is held at a position a small distance radially outwardly of the outer peripheral edge 110 of the drying table. Concentric support ring 21, which is positioned in substantially coplanar relationship with th drying table 20, terminates at an edge surface 112 a small distance, e.g. ½ inch, from the periphery 110 of the drying table, thus defining a circular gap 114 providing an escape route for water draining from the bottle and sleeve, etc. Annular support ring 21 may also be provided with a porous surface to further facilitate water drainage. In the preferred embodiment, best illustrated in FIG. 1, the annular support ring 21 is mounted on a plurality of vertical beams 54 by suitable horizontal support structure 120, FIG. 2. The support ring 21 in turn supports drain channel 31 which is positioned immediately below the support ring and a peripheral portion of the drying table 20. The drain channel 31 may comprise a generally rectangular cross section and may, in turn, discharge as through a vertical conduit 122 into a return reservoir 130. In the preferred embodiment, the support ring 21 and drain channel 31 extend only through the length of the drying path which, in the preferred embodiment illustrated in FIG. 1, comprises an arc of 270 degrees.

As best illustrated by FIG. 2, the heating water which is provided to weirs 26 may be heated in reservoir 130 by an associated heater 132 which is conventionally controlled by a thermostat 134 which may be set at a predetermined value. In the preferred embodiment, the water temperature is at least 130 degrees F. and is preferably between 140 and 180 degrees F. A single weir may be provided or, as illustrated in the preferred embodiment of FIG. 1, a plurality, e.g. 3 weirs having separate flow lines 131, 133, 135, may be provided along the drying path of the bottles. A conventional pumping unit 137 may pump water from the reservoir through lines 131, 133, 135. The rate of water flow to each weir may be preset with a conventional control valve 136 and conventional flow meter 138. In a typical embodiment handling 60 bottles per minute, the total flow rate may be on the order of 30 gallons per minute. As best illustrated in FIG. 2, the water flow through an associated control line, e.g. 131, is directed into a weir 26 which may be supported by a bracket structure 140 conventionally attached to a vertical beam 54. The weir is arranged such that the lip surface 38 over which heating water 30 flows is directed radially outwardly and directs the flow of water onto a radially inwardly located shoulder portion of an associated bottle. The water flow 30 is positioned sufficiently radially inwardly and below of the bottle neck 42 such that none of the water enters the bottle opening 43. The weir structure extends through the entire length of the drying path with only minor gaps provided therein for attachment of the separate weirs. Thus, as a bottle moves through the drying path, it is exposed to a substantial constant cascade of heating water 30 from the weirs 26.

A plurality of resilient bands 24 mounted on associated pairs of vertical posts 150, 152 affixed to annular support ring 21 are provided around the periphery of the drying wheel and make frictional engagement with the outer surface of sleeves 14 positioned within brackets 22. The resilient bands 24 act to hold the sleeves 14 within the enclosures 100 defined by the brackets and also cause the sleeves to rotate as they are moved through the drying path. This rotation of the sleeves acts to help uniformly distribute the flow of heating water from the weirs over the entire surface of each bottle 14 and thereby facilitates uniform heating of each bottle.

As best illustrated by FIG. 2, an air blower 160 may be mounted with suitable support structure 162 in fixed relationship with horizontally extending beam 56 at a position directly above the central axis CC of drying wheel 20. The air blower 160 may have associated therewith a conventional air filter 162 which filters air drawn into the blower 160. Blower 160 communicates with a heating unit 164 positioned immediately below beam 56 through a conventional conduit 166. Heater 164 may be, in turn, placed in fluid communication with an air manifold 168 fixedly attached at the center of drying wheel 20 by a vertically extending conduit 170 having a horizontally extending seal plate 172 fixedly associated therewith which makes sealing, rotating contact with an upper peripheral edge surface 174 of air manifold 168. Thus, plate 172 and conduit 170 remain rotatably stationery while manifold 168 rotates with the drying table 20. A thermostat 176 may be provided in conduit 170 slightly downstream of heater 164. Thus, the temperature of the air provided to the bottles may be controlled by the setting of thermostat 176. In a preferred embodiment, the temperature of air provided to the bottles is between 120 and 180 degrees and is preferably about 140 degrees F. Manifold 168 has a plurality of radially extending conduits 180, 182, 184, etc. attached in fluid communication therewith. In a preferred embodiment, each conduit, e.g. 180, is, in turn, connected to two branch conduits 190, 192. Each branch conduit 190, 192 terminates at a position a small distance, e.g. ¼ inch, above the opening of a bottle situated in an associated bracket 22. In one preferred embodiment, a blocking plate 171, FIG. 1, is mounted on manifold sealing plate 172 at a position such that it blocks the inlet openings of radially extending conduit 180, 182, 184, etc., when these conduits are at arcuate positions outside of the drying path, i.e. in an arc extending approximately from a position adjacent the bottle takeoff device 36 to a position just beyond the bottle infeed device 16. The air flow is blocked to prevent the wet coating on the interior surface of the neck portion of a bottle from being disrupted when the purge air jet 32 initially is brought into position above the bottle as the bottle is being loaded. In a preferred embodiment, the flow rate of air through the blower 160 is such that the air flow rate into each bottle is approximately 2 standard cubic feet per minute during movement of the bottle through the drying path. The heated air blown into the bottle through associated air jets 32, causes rapid evaporation of the moisture within the bottle, e.g. 900 milligrams of water, may be evaporated from a bottle during a single pass through the drying apparatus 10. The duration of a single pass through the device may be on the order of 30 seconds for evaporation of this quantity of water.

Subsequent to passing through the drying path, a sleeve and associated bottle are removed by takeoff device 36 which, in the preferred embodiment illustrated in FIG. 1, includes a table 200 rotating in a direction 202 opposite to that of drying table 20 at a peripheral speed equal to that of drying table 20. A set of vertically extending rails 204, 206 positioned immediately above the takeoff table 20, guide the sleeves 14 along an arcuate path leading to a horizontal conveyor 210 which moves the sleeves and associated bottles onto the next operating station in the direction 212. The bottles may thereafter have further operations performed thereon including removal thereof from associated sleeves.

Thus it may be seen that during operation of the present invention, bottles are placed within relatively closely fitting sleeves and moved along a drying path. As the bottles are moved along the drying path, the exterior surfaces thereof are contacted by a flow of heated water which transfers heat to the bottles and moisture therein to facilitate the evaporation and drying process. As the bottles are moved along the drying path, they are also exposed to a jet of air directed into each bottle which causes the moisture therein to be evaporated.

It is contemplated that the inventive concepts herein described may be variously otherwise embodied and it is intended that the appended claims be construed to include alternative embodiments of the invention except insofar as limited by the prior art.

What is claimed is:

1. An apparatus for high speed production drying of plastic bottles, interior surfaces subsequent to spray coating thereof with an aqueous mixture of coating material, the plastic constructed of a material which is subject to deterioration when exposed to temperatures in excess of 185 degrees F., the coating material being of a type which is subject to cracking when dried at temperatures in excess of 185 degrees F., the apparatus comprising:

(a) a plurality of sleeve means for receiving bottles having a shoulder therein in an upright position each comprising:

a vertically extending side wall having a height approximately equal to the shoulder height of a bottle to be dried and having an internal diameter slightly larger than the external diameter of a bottle to be dried;

an open top portion for enabling insertion and removal of a bottle from the sleeve in an orientation wherein the central longitudinal axes of the bottle and said sleeve means are substantially coaxial; and an opening in the bottom portion thereof for enabling gravity discharge of water therefrom;

(b) sleeve conveying means for transporting said sleeve means and associated bottles through a fixed distance along which said bottles are exposed to drying operations;

(c) sleeve holding means for holding said sleeve means and associated bottles at relatively fixed, spaced apart positions on said conveying means;

(d) heated water discharge means for directing a substantially continuous flow of heated water at a temperature less than 185 degrees F. onto upper exterior surfaces of bottles as the bottles are moved along said sleeve conveying means; the relationship of said sleeve means with the bottles being such that a narrow width annular water chamber is defined by the peripheral wall of said sleeve means and the outer peripheral surface of an associated bottle, said heated water being directed by said annular water chamber over substantially all of the exterior peripheral wall surface of a bottle portion encompassed by said sleeve means whereby relatively uniform heating of the bottle is provided; whereby the temperature of said aqueous mixture of coating material is elevated to increase the drying rate thereof;

(e) drying air discharge means for directing a flow of drying air at a temperature of less than 185 degrees F. into the interior cavity of bottles as the bottles are moved along said sleeve conveying means; whereby the interiors of said bottles are rapidly dried without causing deterioration of said bottles or said coating layers thereof through exposure of said bottles to elevated temperatures.

2. The invention of claim 1 wherein the temperature of water discharged by said heated water discharge means is at least 130 degrees F.

3. An apparatus for high speed production drying of plastic bottles, interior surfaces subsequent to spray coating thereof with an aqueous mixture of coating material, the plastic bottles being constructed of a material which is subject to deterioration when exposed to temperatures in excess of 185 degrees Fahrenheit, the coating material being of a type which is subject to cracking when dried at temperatures in excess of 185 degrees Fahrenheit, the apparatus comprising:

(a) a plurality of sleeve means for receiving bottles having a shoulder therein each comprising:

a vertically extending side wall having a height approximately equal to the shoulder height of a bottle to be dried and having an internal diameter slightly larger than the external diameter of a bottle to be dried;

an open top portion for enabling insertion and removal of a bottle from the sleeve in an orientation wherein the central longitudinal axes of the bottle and said sleeve means are substantially coaxial; and an opening in the bottom portion thereof for enabling gravity discharge of water therefrom;

(b) sleeve conveying means for transporting said sleeve means and associated bottles through a fixed distance along which said bottles are exposed to drying operations;

(c) sleeve holding means for holding said sleeve means and associated bottle at relatively fixed, spaced apart positions on said conveyeing means;

(d) heated water discharge means for directing a substantially continuous flow of heated water at a temperature less than 185 degrees Fahrenheit onto upper exterior surface of bottles as the bottles are moved along said sleeve conveying means; the relationship of said sleeve means with the bottles being such that a narrow width annular chamber is defined by the peripheral wall of said sleeve means and the outer peripheral surface of an associated bottle, said heated water being directed by said annular water chamber over substantially all of the exterior peripheral wall surface of a bottle portion encompassed by said sleeve means whereby relatively uniform heating of the bottle is provided; whereby the temperature of said aqueous mixture of coating material is elevated to increase the drying rate thereof;

(e) drying air discharge means for directing a flow of drying air at a temperature of less than 185 degrees Fahrenheit into the interior cavity of bottles as the bottles are moved along said sleeve conveying means; whereby the interior of said bottles are rapidly dried without causing deterioration of said bottles or said coating layers thereof through exposure of said bottles to elevated temperatures; and (f) sleeve rotating means for rotating said sleeve means and associated bottles about said sleeve means central longitudinal axes during movement thereon on said conveyor means, whereby each bottle mounted in a sleeve means is rotated approximately about its central longitudinal axis during movement thereof on said conveying means whereby uniform flow of heated waste over the surface of the bottles is enhanced.

4. The invention of claim 3 wherein said sleeve conveying means comprises a rotating table.

5. The invention of claim 4 wherein said sleeve holder means comprises brackets fixedly mounted in spaced apart circumferential relationship on said rotating table.

6. The invention of claim 5 wherein each said bracket comprises a radially outwardly opening pair of arms having roller means associated therewith for rollingly engaging an outer peripheral surface of an associated sleeve means,

7. The invention of claim 3 or 6 wherein said rotation means comprises at least one resilient band positioned proximate said sleeve conveying means in frictionally engageable contact with an exterior surface of said sleeve means during transport thereof by said sleeve conveyor means; said conveyor means being moveable relative said resilient band.

8. The invention of claim 4 said rotating table is rotatingly moveable relative said heated water discharge means.

9. The invention of claim 8 wherein said heated water discharge means comprises at least one weir positioned above said table means proximate an outer circumferential portion thereof.

10. The invention of claim 9 further comprising drain means for receiving water from said heated water discharge means subsequent to passage thereof through said sleeve means, said drain means being positioned below said sleeve holding means.

11. The invention of claim 4 wherein said air direct means comprises a plurality of relatively small diameter conduits each said conduit terminating proximate and in alignment with the opening of a bottle to be dried in an associated bracket.

12. The invention of claim 11 wherein said plurality of relatively small diameter conduits are relatively fixed with respect with said table and are rotatable therewith.

13. The invention of claim 12 wherein said relatively small diameter conduits are attached in fluid communication with an air manifold affixed to said rotating table and operatively connected to an air supply source by a rotating seal assembly.

14. The invention of claim 13 wherein said air supply source comprises blower means for providing a continuous pressurized airflow into said air manifold.

15. The invention of claim 13 further comprising air heater means operatively associated with said air supply source for heating air supplied to said manifold to a preset temperature.

16. The invention of claim 15 wherein said preset air temperature is between 120 degrees F. and 160 degrees F.

17. The invention of claim 13 further comprising conduit blocking means operatively associated with said small diameter conduits for interrupting airflow thereto during a period of time wherein said conduits are initially moved into position above associated bottles being loaded onto said brackets on said rotating table whereby airflow from said small diameter conduits is discharged only into the interior of said associated bottle whereby an interior coated portion of the bottle neck portion is not disrupted by said airflow during loading of said bottles.

18. An apparatus for high speed production drying of polystyrene bottles, interior surfaces or the like having a generally cylindrical configuration with a tapering upper shoulder portion, and a neck portion defining a central bottle the apparatus comprising:

(a) a plurality of cylindrical sleeves having a diameter slightly greater than the maximum diameter of the bottles to be dried and having a height approximately equal to the shoulder height of the bottles, said cylindrical sleeves each having a base surface for supporting a bottom surface of a bottle thereon, an open upper end enabling insertion of a bottle into said sleeve in approximately coaxial relationship therewith, an inner centering and shock absorber means for centrally positioning and holding the bottle within said cylindrical sleeve and absorbing shocks and an opening in a lower portion thereof to facilitate removal of heating water therefrom;

(b) generally horizontally disposed sleeve infeed means for feeding said plurality of sleeve means and a plurality of bottles mounted in upright relationship therein into a drying path conveyor, said sleeve infeed means including a horizontal feed track and a horizontally disposed screw positioned parallel to said feed track, said screw having a spiral groove with a surface adapted to engage exterior surfaces of said sleeve means for producing spaced apart horizontal displacement of said sleeve means along said horizontal feed track;

(c) horizontally disposed drying table means rotatable about a central vertical axis for receiving said sleeve means in spaced apart relationship from said infeed means and for conveying said sleeve means and associated bottles through a drying path;

(d) horizontally disposed takeoff means for sequentially removing said sleeve means and associated bottles from said drying table means, said takeoff means comprising a horizontally disposed rotatable takeoff table positioned adjacent said drying table means and rotatable at a speed whereby the tangential peripheral speed of said drying table means is approximately equal to the tangential peripheral speed of said takeoff table;

(e) a plurality of circumferentially, equally spaced apart bracket means fixedly mounted on an outer peripheral portion of said rotatable drying table means and adapted to receive said sleeve means from said sleeve infeed means, said bracket means having at least two arm portions defining a radially outwardly opening enclosure and having rollers disposed thereon for allowing relative rotational movement of said sleeve means within said bracket means;

(f) resilient band means positioned proximate the periphery of said drying table means in generally tangential relationship therewith in frictionally contacting relationship with said sleeve means, said drying table mean being rotatable relative said band means whereby said sleeve means are rotatable within said bracket mean by said frictional contact with said band means;

(g) weir means for dispensing a uniform flow of heated water from an arcuate lip portion thereof positioned above said drying wheel, said lip portion being disposed such that said heated water flow is directed onto the shoulder portion of bottles positioned in said sleeve means at a position thereon outwardly of the bottle openings whereby said heated water heats the bottle without entering the bottle openings;

(h) drain channel means disposed below said table means beneath said bracket means for draining water flowing from said weir means;

(i) a plurality of air jet directing means fixedly mounted on said drying table means and operatively associated with said bracket means for directing a drying airflow into a bottle positioned in a sleeve engaged by said bracket means;

(j) manifold means fixedly mounted at a central position on said drying table means and connected in fluid communication with said air jet directing means for providing uniform pressure airflow to said air jet means; said manifold means being operatively attached to a heated, pressurized air source by an air duct and rotating seal;

(k) drive means for driving said infeed screw, said drying table means and said takeoff table in operatively synchronized relationship.

19. The invention of claim 18 wherein said drying path comprises an arc of substantially 270 degrees.

20. The invention of claim 18 wherein the flow rate of air from an air jet means is between 1 standard foot cubic per minute and 3 standard cubic feet per minute and wherein the temperature of said air is between 120 degrees F. and 180 degrees F.

21. The invention of claim 20 wherein the temperature of said heated water in said weir is at least 130 degrees F.

22. The invention of claim 21 wherein the diameter of said sleeve means is between $\frac{1}{8}$ inches and $\frac{1}{2}$ inches greater than the maximum diameter of an associated bottle.

23. A method for drying plastic bottles, interior surfaces subsequent to spray coating thereof with an aqueous mixture of coating material during a high speed plastic bottle production operation, the plastic bottles being constructed of a material which is subject to deterioration when exposed to temperature in excess of 185 degrees Fahrenheit, the coating material being of a type which is subject to cracking when dried at temperatures in excess of 185 degrees Fahrenheit, comprising the steps of:

(a) mounting each bottle in a loosely fitting sleeve in an upright position;

(b) moving the sleeves and bottles along a predetermined drying path;

(c) rotating each bottle about a central longitudinal axis as it is moved along the drying path;

(d) directing a stream of heated liquid onto an upper shoulder surface of each bottle as it is moved along the drying path, the heated liquid being at a temperature less than said deterioration temperature of said bottle;

(e) during a period when said bottles are exposed to said heated liquid directing a stream of pressurized air into each bottle as it is moved along the drying path; the temperature of the pressurized air being less than said deterioration temperature, so as to rapidly dry each bottle without raising the temperature thereof above asid deterioration temperature.

* * * * *

UNITED STATES PATENT AND TRADEMARK OFFICE

CERTIFICATE OF CORRECTION

PATENT NO. : 4,683,009

DATED : July 28, 1987

INVENTOR(S) : Frank L. Shriver

It is certified that error appears in the above-identified patent and that said Letters Patent is hereby corrected as shown below:

Column 2, line 19, "laye" should read --layer--.
Column 5, line 46, "ribs 5" should read --ribs 55--.

In the Claims

Claim 1, Column 9, line 17, "bottles," should read --bottles'--; and
line 19, after "plastic", --bottles being-- should be inserted.
Claim 3, Column 10, line 8, "bottles," should read --bottles'--;
line 43, before "chamber", insert --water--;
line 65, "thereon" should read --thereof--; and
Column 11, line 1, "waste" should read --water--.
Claim 11, Column 11, line 32, "direct" should read --directing--.
Claim 18, Column 11, line 67, "bottles," should read --bottles'--.
Claim 23, Column 14, line 3, "bottles," should read --bottles'--.

Signed and Sealed this

Twenty-fourth Day of November, 1987

*Attest:*

DONALD J. QUIGG

*Attesting Officer*

*Commissioner of Patents and Trademarks*